252-99 AU 157 EX
3/24/87 OR 4,652,391

United States Patent [19]
Balk

[11] Patent Number: 4,652,391
[45] Date of Patent: Mar. 24, 1987

[54] HIGH POWDER DENSITY FREE-FLOWING DETERGENT

[75] Inventor: Manfred Balk, Hermonville/Reims, France

[73] Assignee: Henkel Kommanditgesellschaft auf Aktien, Duesseldorf, Fed. Rep. of Germany

[21] Appl. No.: 779,331

[22] Filed: Sep. 23, 1985

[30] Foreign Application Priority Data

Sep. 22, 1984 [DE] Fed. Rep. of Germany ..... 3434854

[51] Int. Cl.[4] ..... C11D 17/06
[52] U.S. Cl. ..... 252/99; 252/135; 252/174; 252/174.25
[58] Field of Search ..... 252/99, 135, 174.25, 252/174

[56] References Cited

U.S. PATENT DOCUMENTS

| | | | |
|---|---|---|---|
| 2,941,947 | 6/1960 | Schauer | 252/135 |
| 3,741,913 | 6/1973 | Waag | 252/544 |
| 3,838,072 | 9/1974 | Smith, Jr. et al. | 252/540 |
| 3,849,327 | 11/1974 | DiSalvo et al. | 252/109 |
| 3,886,098 | 5/1975 | DiSalvo et al. | 252/540 |
| 4,083,813 | 4/1978 | Wise et al. | 252/135 |
| 4,280,920 | 7/1981 | Garvey et al. | 252/173 |
| 4,444,673 | 4/1984 | Joshi et al. | 252/90 |

FOREIGN PATENT DOCUMENTS

| | | |
|---|---|---|
| 852173 | 9/1970 | Canada . |
| 2412837 | 11/1973 | Fed. Rep. of Germany . |
| 2742683 | 9/1976 | Fed. Rep. of Germany . |

OTHER PUBLICATIONS

Soap, Cosmetic's Chemical Specialties—Aug. 1972, pp. 27 to 30, 44, 46.

*Primary Examiner*—A. Lionel Clingman
*Assistant Examiner*—Hoa Van Le
*Attorney, Agent, or Firm*—Henry E. Millson, Jr.; Mark A. Greenfield; Real J. Grandmaison

[57] ABSTRACT

A process for the production of a granular, free-flowing detergent composition which is rapidly soluble in water, and the product thereof which has a bulk density of at least 600 g/l and a particle size of 0.1–2 mm, wherein an aqueous slurry of the composition ingredients is continuously homogenized to yield a viscosity of 4,000 to 20,000 mPa.s and heated to a temperature of 85°–105° C. The homogenized heated slurry is then sprayed in a drying tower through nozzles having a bore diameter of 2.5–5 mm under a pressure of 20–45 bar. The slurry and resulting product contain 10–28% alkoxylated nonionic surfactant, 40–80% inorganic carrier and 0.5–10% organic washing auxiliary.

35 Claims, No Drawings

HIGH POWDER DENSITY FREE-FLOWING DETERGENT

BACKGROUND OF THE INVENTION

1. Field of the Invention

This invention relates to a process for manufacturing detergent compositions with predominantly alkoxylated nonionic surfactants having a high powder density and which is free-flowing.

2. Statement of the Related Art

In recent years, there has been an increasing interest in detergents having a comparatively high powder (bulk) density of more than 600 g/l because they require less packaging volume for the same active ingredient content and thus enable a significant reduction of packaging material size. Washing powders of high powder density have been known for some time and include compositions of high soda or silicate content obtained simply by mixing the individual constituents together or by drying aqueous mixtures thereof on shelves or heated rolls, followed by extrusion or spray crystallization. These powders, which have a high specific gravity, tend to cake, generally show inadequate dissolving properties, and cannot be used in modern washing machines with preprogrammed wash cycles. Accordingly, compositions of this type have been replaced by low specific gravity powders having a porous grain structure which are produced by hot spray drying and which, although generally dissolving rapidly, are relatively bulky in terms of packaging and transport.

It is also known that the powder density of spray-dried powders such as these can be increased by subsequently spraying them with liquid or molten nonionic surfactants. By virtue of the favorable washing properties of nonionic surfactants, this also increases the detergency of the powders and avoids the problem of pluming in the exhaust of the spray drying towers which occurs during hot spray drying and which is caused by entrained nonionic material. The process in which the nonionic surfactant is applied to spray-dried polyphosphate only gives powder densities of less than 550 g/l. U.S. Pat. Nos. 3,838,072; 3,849,327; and 3,886,098 describe a similar process in which a granular, porous carrier material is prepared by spray drying a slurry of inorganic salts such as sodium silicate, sodium sulfate and sodium triphosphate; sulfonate surfactants; and soaps; and is subsequently sprayed with a nonionic surfactant in a mixer. In this way, up to 20% by weight of nonionic surfactants may be subsequently applied to the spray-dried carrier material. In order to improve the flow properties, the addition of a powder, for example talcum, finely divided silica or calcined clay, is recommended. A powder-form redeposition inhibitor such as carboxymethyl cellulose may also be subsequently added. The powders charged with nonionic surfactants obtained in this way generally have a powder density of 300 to 600 g/l, with an undesired high of 700 g/l, and a fluidity of up to 76% of that of dry sand. The powder particles vary from 0.075 mm to 3.3 mm and more especially from 0.15 mm to 0.83 mm in size.

Granular detergents having a powder density of 550 to 800 g/l which consist of essentially spherical particles having a certain particle size and which have a fluidity of at least 75% and up to almost 100% based on dry sand, are known from published German Application No. 27 42 683 and U.S. Pat. No. 4,444,673. These known detergents, which are packed in plastic bottles, contain 30 to 80% builders, 2 to 40% surfactants which are mostly nonionic, 0 to 20% other additives, and 0 to 50% fillers, and have a moisture content of 3 to 15%. Although it is disclosed that these detergents may be produced by any method, including spray drying or granulation, the preferred method and only method specifically described is based on a complicated two-stage process in which base beads having a porous outer surface and a more or less absorbent interior are initially prepared by spray drying an aqueous slurry and are then sprayed or impregnated with the liquid or molten nonionic surfactant. Apart from the complicated nature of this process, difficulties are involved in preparing non-tacky granules containing more than 20% of the liquid or low-melting nonionic surfactants. In addition, the products show comparatively unfavorable dissolving properties in cold tap-water, so that undissolved fractions can remain behind in the powder dispenser compartment or in the liquid dispenser container of tumbler-type washing machines of the type commonly used in Europe.

Finally, Canadian Pat. No. 852,173 and corresponding published German patent application No. 17 92 434 describe a process for the production of granular detergents containing 2 to 15% by weight of anionic surfactants, 5 to 20% by weight of nonionic surfactants and 25 to 60% by weight of tripolyphosphate, by spray drying a slurry. The tripolyphosphate used for preparing the slurry must be partly prehydrated. This partial prehydration is critical to the formation of free-flowing powders. This known process yields loose powders having a powder density of less than 550 g/l and, where the nonionic surfactant content is considerably in excess of 15% by weight, only very moderate flow properties. Thus, it is impossible to transfer the powder in defined quantities from a box or bottle into a measuring cup because it does not flow uniformly. On the contrary, when the container is tilted and shaken, however carefully, to dispense the powder, the powder does not flow out uniformly, but instead sticks or shoots uncontrollably out of the opening so that the measuring cup often overflows and relatively large quantities of powder are spilt.

Accordingly, the problem posed was to produce a granular detergent component while avoiding the known disadvantages and which:

(a) has a high powder density so that the packaging volume can be considerably reduced, i.e. to around half that of a conventional spray-dried detergent:

(b) has a much higher content of wash-active substance (about twice normal) so that the detergent develops the same washing power as a conventional spray-dried powder when used in smaller amounts, for example in amounts reduced by half:

(c) is so free-flowing that it may be poured out like a liquid and may be exactly dispensed into a measuring cup simply by tilting the container (despite the resulting high content of nonionic surfactants which are known to increase the tendency of a powder toward caking); and (d) can be produced by a single-stage process without any particular technical problems arising.

In attempting to solve this problem one is confronted by the following negative aspects:

A spray-drying process carried out under the usual conditions, i.e. by pressure atomization of aqueous suspensions, offers little in the way of a solution to this problem because spray drying generally gives expanded, i.e. porous, granules having correspondingly low powder densities. Although the subsequent addition of or impregnation with liquefied nonionic surfactants would have more or less filled the pores of the granules and increased the powder density accordingly, the two-stage procedure is both time consuming and requires very expensive apparatus because of the need to dispense, mix and granulate large quantities of powder and then to remove the coarser aggregates. In addition, a procedure such as this necessitates the production of relatively strong, i.e. abrasion-resistant, granules. Granules such as these, which normally contain relatively high percentages of sodium silicate as strength promoter, generally show only moderate dissolving properties, particularly in cold water, and frequently have only a limited uptake capacity for liquid or tacky nonionic surfactants.

There are no known processes for directly producing heavy powders of the type in question with a high nonionic surfactant content by spray drying. First, there were serious doubts regarding the spray drying of powders having a high surfactant content, particularly a high nonionic surfactant content, because of the danger of dust explosions and the extensive pluming expected in the exhaust of the spray drying towers. Accordingly, the relevant patents and literature in the art warn against processing highsurfactant mixtures such as these in hot spray drying towers and instead propose incorporating higher percentages of nonionic surfactant in preformed carrier grains by spray granulation. Second, conventional techniques for preparing and further processing the aqueous concentrates (slurries) and subsequent hot spray drying were specifically developed to form porous, loose powders of low powder density. Accordingly, these techniques appeared unsuitable for the production of compact, low-dust powders having approximately double the normal powder density.

There are essentially two known processes for preparing and further processing the slurry. In the semi-continuous process, at least two mixing vessels operating alternatively are used. This inevitably results in prolonged dwell times during which the tripolyphosphate is hydrated and viscosity increases. The spraying of these viscous slurries under pressures of 30 to 70 bar through nozzles which normally have a bore diameter of 2.5 to 4 mm results in the formation of loose powders having a powder density below 400 to 450 g/l. Another process, described in "Soap and Cosmetic Specialities", August 1972, pages 27 to 30, 44 and 46, uses continuous metering, mixing and pumping systems. The individual constituents are continuously weighed or volumetrically measured, premixed and transferred to a homogenizing unit. After passing through a filter, in which relatively coarse agglomerates are removed or broken up, the slurry flows through a second homogenizing unit to a high-pressure pump by which it is pumped to a spray-drying tower under a pressure of 30 to 70 bar. This continuous procedure avoids prolonged dwell times and large increases in the viscosity of the slurry, but also gives powders having a powder density of only 100 to at most 450 g/l. A low content of washing-active substance, which is equivalent to a high content of builder salts, and high spraying pressures promote a higher powder density, although even here the upper limit is at 400 to 450 g/l. To produce more compact heavy powders, therefore, the spray-dried product has to be further processed and mixed with powders of high specific gravity in apparatus specially designed for this purpose. This requires higher plant investment and more work.

DESCRIPTION OF THE INVENTION

Other than in the operating examples, or where otherwise indicated, all numbers expressing quantities of ingredients, reaction conditions, or defining ingredient parameters used herein are to be understood as modified in all instances by the term "about".

The present invention, which solves the problems discussed above, relates to a process for the production of a granular, free-flowing detergent composition wich dissolves rapidly in water and which has a powder (bulk) density of at least 600 g/l for a particle size of from 0.1 to 2 mm, containing (a) at least one alkoxylated nonionic surfactant, (b) at least one inorganic carrier, (c) at least one other organic washing auxiliary and (d) water bound by adsorption and water of hydration. The detergent composition contains 10 to 28% by weight of constituent (a): 40 to 80% by weight of constituent (b): 0.5 to 10% by weight of constituent (c): 10 to 20% by weight of constituent (d); and from 0 to less than 0.5% by weight of anionic surfactants.

An aqueous slurry of the ingredients having a viscosity of from 4,000 to 20,000 mPa.s and a temperature of 85° to 105° C. is continuously homogenized and sprayed through nozzles into a drying tower under a pressure of from 20 to 45 bar using a nozzle with a bore diameter of from 2.5 to 5 mm, the ratio of the pressure at the nozzle entrance to the nozzle bore diameter being 4 to 18 (bar/mm). The bulk density of detergent compositions according to this invention is preferably 650 to 850 g/l, most preferably 700 to 800 g/l.

COMPOSITION INGREDIENTS

Alkoxylated nonionic surfactants suitable for use in the production of the detergent component are $C_{12-24}$, preferably $C_{14-18}$, containing on average 3 to 20, preferably 4 to 16, glycol ether moieties. The hydrocarbon radicals may be saturated or monounsaturated, linear or methyl-branched in the 2-position (oxo radical), and may be derived from naturally occurring or hydrogenated fatty residues and/or synthetic residues. Ethoxylates derived from cetyl, stearyl and oleyl alcohol and mixtures thereof have proved to be particularly suitable. Examples are tallow fatty alcohols containing on average from 4 to 8 ethylene oxide (EO) moieties, tallow fatty alcohol containing on average from 10 to 18 EO and oleyl alcohol containing on average from 6 to 12 EO and also mixtures thereof. Mixtures of two and more surfactants differing in their EO-content, in which the proportion of more highly ethoxylated alcohols predominates, have proved to be particularly advantageous because the tendency towards pluming in the tower exhaust is particularly low and because detergency with respect to mineral and greasy soil is particularly pronounced.

Examples of mixtures of the type in question are combinations of:

(a1) tallow alcohol containing from 4 to 6 EO, (a2) tallow alcohol containing from 12 to 16 EO (a3) technical oleyl alcohol (i.e. mixtures of oleyl and stearyl alcohol) containing from 6 to 12 EO, in which (a1) and (a2) are present in a ratio of 1:0.5-4 respectively, as well as in which (a1), (a2), and (a3) are present in a ratio of 1:0.5:0.5-5 or 1:1-4:1, respectively.

Other nonionic surfactants which have proved advantageous in the sense of a minimal tendency towards "pluming" are alkoxylated $C_{12-24}$, preferably $C_{14-18}$ alcohols in the production of which 1 to 3 mols of propylene oxide and then 4 to 20, preferably 4 to 7, mols of ethylene oxide are added onto the alcohol. More particularly, these alcohols may completely or partly replace components (a1) and (a2) in the above-mentioned mixtures.

Ethoxylated $C_{8-12}$- alkylphenols containing 4 to 14 EO have also proved suitable. Mixtures of ethoxylated nonylphenols containing (a4) 5 to 7 EO and (a5) 9 to 12 EO in a ratio of 1:0.5-4 are particularly suitable.

Other suitable nonionic surfactants are those which show a similar distribution of the ethylene glycol or propylene glycol ether moieties and which are derived from vicinol diols, fatty amines, fatty acid amides and fatty acids. The ethoxylated fatty acid amides also include fatty acid mono- and diethanolamides and the corresponding fatty acid propanolamides. It is also possible to use water-soluble polyethylene oxide adducts—containing 20 to 250 ethylene glycol ether moieities and 10 to 100 propylene glycol ether moieties—with polypropylene glycol, ethylene diaminopolypropylene glycol and alkyl polypropylene glycol containing 1 to 10 carbon atoms in the alkyl chain. The compounds mentioned normally contain 1 to 5 ethylene glycol units per propylene glycol unit.

Finally, nonionic surfactants of the amine oxide type may also be present. It is even possible to use amine oxides containing polyglycolether moieties.

The detergent composition according to the invention contains 10 to 28, preferably 12 to 25 and more preferably 15 to 23% by weight of alkoxylated nonionic surfactants.

The detergent composition should contain less than 0.5%, preferably 0%, of anionic surfactants, i.e. surfactants of the sulfonate or sulfate type, and soap. This is because it has been found that even small amounts of anionics, particularly the slightest additions of soap, result in expansion of the granules during spray drying and thus in a reduction both in the high powder density required and in fluidity.

Suitable inorganic carriers are preferably builders which are also capable of binding or rather precipitating the salts responsible for hardness in water. These include the polymer phosphate alkali metal and ammonium salts, more especially sodium tripolyphosphate, and also more highly condensed polymer phosphates, such as sodium tetraphosphate. The polymer phosphates may be present in admixture with their hydrolysis products, i.e. ortho- and pyrophosphate, although suitable measures should be taken to minimize hydrolysis of the polyphosphate during preparation of the slurry and during spray drying because of the relatively high detergency and calcium binding power of polyphosphates. The sodium tripolyphosphate is preferably used in anhydrous form or as a partially hydrated salt containing up to 2% by weight of water of crystallization.

Other suitable carriers include synthetic sodium aluminosilicates containing bound water of the zeolite A type. They may completely or partly replace the polymer phosphates, i.e. their use permits the production of phosphate-free detergents.

The zeolites are used in the usual hydrated, finely crystalline form, i.e. they contain virtually no particles larger than 30 microns in size and preferably comprise at least 80% of particles less than 10 microns in size. Their calcium binding power, as determined in accordance with published German patent application No. 24 12 837 (and corresponding Canadian Pat. No. 1,036,455) is in the range 100 to 200 mg CaO/g. Zeolite NaA is particularly suitable although zeolite NaX and mixtures of NaA and NaX may also be used.

Alkali metal silicates are an essential constituent of the carrier, more especially sodium silicates having the composition $Na_2O:SiO_2=1:1.5-3.5$, preferably 1:2-2.5. It is also possible to use mixtures of silicates differing in their alkali content, for example a mixture of $Na_2O:SiO_2=1:2$ and $Na_2O:SiO_2=1:2.5-3.3$, although the proportion of silicates having the higher $Na_2O$ content should best predominate in the interests of a high powder density.

Other suitable carriers which may be present in admixture with the compounds mentioned above are sodium carbonate, sodium sulfate and magnesium silicate. Compounds having a high adsorption capacity, such as finely divided silica, clays or bentonites, and their mixtures may also be present.

The total inorganic carrier content compared to the total composition amounts to 40–80, preferably 45–70%, by weight, by weight, based on anhydrous or nonhydrated constituents. The alkali metal (especially sodium) tripolyphosphate content (including hydrolysis products) is 0–60%, preferably 10–50%, more preferably 20–40%, by weight. The alkali metal silicate content is 5–20%, preferably 6–15%, more preferably 6.5–12%, by weight. The alkali metal (especially sodium) aluminosilicate content is 0–40%, preferably 3–30%, more preferably 5–25%, by weight. The sodium silicate content of carrier salt mixtures of the type in question, which consist essentially of sodium tripolyphosphate or zeolite and mixtures thereof may also be increased beyond the indicated maximum of 20% by weight without any serious disadvantages arising in regard to the dissolving behavior of the particles. The same applies in cases where the sodium aluminosilicate content is increased beyond the indicated maximum of 40% by weight. In cases such as these, the zeolites may be present in quantities of up to 65% by weight.

Although the percentage polyphosphate content of the detergent composition according to the invention may be equivalent to that of conventional heavy-duty detergents, the trend towards phosphate reduction is fully taken into consideration. First, the detergents according to the invention are used in very much smaller quantities by comparison with conventional (i.e. low specific gravity) washing powders and, second, the phosphate content may be considerably reduced in favor of the alumosilicate content, for example down to 10% by weight, or even eliminated altogether.

The process product may additionally contain as other organic washing auxiliaries co-builders which are capable, even in small quantities, of considerably enhancing the effect of the polyphosphates and sodium aluminosilicates. Suitable co-builders include polyphosphonic acids and alkali metal salts thereof. Suitable polyphosphonic acids are: 1-hydroxyethane-1, 1-diphosphonic acid: aminotri(methylenephosphonic acid): ethylene diamine tetra-(methylene-phosphonic acid); and higher homologs thereof, such as diethylene triamine penta-(methylenephosphonic acid). Other suitable co-builders are complexing aminopolycarboxylic acids, including alkali salts of nitrolotriacetic acid and ethylene diaminotetraacetic acid. Other suitable co-builders are the salts of diethylene triamine pentaacetic acid and higher homologs of the above-mentioned aminopolycarboxylic acids. The polyacids mentioned are preferably used in the form of sodium salts.

Other suitable co-builders are the polymeric carboxylic acids having a molecular weight of at least 350 in the form of their water-soluble sodium or potassium salts. Examples include: polyacrylic acid, polymethacrylic acid, poly-α-hydroxy-acrylic acid, polymaleic acid, polyitaconic acid, polymesaconic acid, polybutenetricarboxylic acid and copolymers of the corresponding monomeric carboxylic acids with one another or with ethylenically unsaturated compounds, such as ethylene, propylene, isobutylene, vinylmethylether or furan. One specific example is the copolymer of maleic acid and acrylic acid in a ratio of 1:0.2–5. The "small" quantities of these co-builders are understood to be quantities of 0.5–10%, preferably 1–5%, by weight, based on the total quantity of the detergent composition.

Other organic detergent constituents which may be present in the spray-dried powder compositions are redeposition inhibitors, optical brighteners and additives which regulate the viscosity behavior of the slurry, such as alkali salts or toluene, cumene or xylene sulfonic acid and, optionally, polymers acting as thickeners (for example of the polyacrylic acid type).

Suitable redeposition inhibitors are, in particular, carboxymethyl cellulose, methyl cellulose, water-soluble polyesters and polyamides of polybasic carboxylic acids and glycols or diamines containing free carboxyl, betaine or sulfobetaine groups capable of salt formation and also colloidally water-soluble polymers or copolymers of vinyl alcohol, vinyl pyrrolidone, acrylamide and acrylonitrile. These organic detergent constituents may be present in quantities of from 0.05 to 10% by weight, based upon the weight of the entire composition.

Suitable optical brighteners are the alkali salts of 4,4-bis-(2"anilino-4"-morpholino-1,3,5-triazinyl-6"-amino)-stilbene-2,2-disulfonic acid or compounds of similar structure which, instead of the morpholino group, contain a diethanolamino group, a methylamino group or a β-methoxyl-ethylamino group. Brighteners of the substituted diphenyl-styryl type, for example the alkali salts of 4,4-bis-(2-sulfo-styryl)-diphenyl, 4,4-bis-(4-chloro-3-sulfostyryl)-diphenyl and 4-(4-chlorostyryl)-4-(2-sulfostyryl)-diphenyl, are also suitable.

The detergent composition according to the invention normally contains 8 to 20%, preferably 12 to 18%, by weight of water, including both the water bound by adsorption and the water of hydration.

The hydrated sodium aluminosilicate contains around 20% by weight of bound water, based on the hydrated sodium aluminosilicate as a whole, i.e. it is the degree of hydration which is adjusted in equilibrium with the surrounding environment. This percentage must be taken into account when calculating the quantity of water. In principle, the water content should be gauged in such a way that the end products flow satisfactorily.

PROCESS PARAMETERS

Preparation and processing of the aqueous slurry intended for spray drying are carried out continuously with very short residence times. Apparatus suitable for the continuous processing of slurries are known and are described, for example, in the journal "Soap, Cosmetics, Chemical Specialities", August 1972, pages 27 to 30, 44 and 46, more especially at 28 to 30, under the heading "Dosex-Slurry-System". It consists of automatic weighing and proportioning units for the solid and liquid or pasty starting materials and of continuous mixers, pumps and filters for separating coarse fractions. The inflow of starting materials to the mixing unit and the outflow of the homogenized slurry to the high-pressure pump and from there to the spray dryer are automatically controlled. This enables short residence times to be obtained and also counteracts the tendency towards inhomogeneity and separation in the slurry.

In one preferred procedure, the metered or proportioned liquid to pasty starting materials are mixed and homogenized in a mixer and, more especially, in two or three successive mixers.

The liquid constituents, more especially the water added, are best used in preheated form, i.e. at a temperature of at least 60° C. The liquid constituents include in particular the molten nonionic surfactants, the aluminosilicate present in the form of a filter-moist paste and the aqueous solution of the soluble sodium silicate (waterglass solution). It is also advisable to introduce these liquid constituents and, optionally, the additional water first and then to add the anhydrous constituents, more especially the anhydrous or, optionally, partly hydrated tripolyphosphate with vigorous stirring.

In order to guarantee adequate fluidity of the slurry and also spray-dried products having favorable powder properties, the viscosity of the slurry is adjusted to a value of 4,000 to 20,000 mPa.s, preferably 5,000 to 20,000 mPa.s, most preferably 5,000 to 15,000 mPa.s, for temperatures of 85° C. to 105° C., preferably 90° C. to 102° C. Heating is best carried out by preheating the liquid starting materials and/or by introducing steam, particularly superheated steam. At the temperatures indicated, hydration of the tripolyphosphate in the slurry is largely suppressed or delayed to such an extent that there is no undesirable increase in viscosity during processing. By controlling the temperature in this way, it is possible to use both rapidly and only moderately hydrating tripolyphosphates. Keeping the slurry liquid and the homogenization thereof are assisted by the application of strong shear forces during intensive mixing using a high-speed stirrer, for example a turbine stirrer rotating at 300 to 600 revolutions per minute. The application of powerful shear forces also prevents structural viscosities from developing. In the case of slurries which do not contain sodium tripolyphosphate, the use of viscosity regulators additionally ensures that the viscosity remains in the preferred ranges.

The aqueous slurry contains a total of 50 to 35%, and preferably 45 to 38%, by weight of water, including the water bound by adsorption and water of hydration, which are present in the quantities previously stated. Higher water contents are undesirable because they increase the degree of hydrolysis of the tripolyphosphate and the energy consumption and lead to a reduction in powder density. Lower water content can lead to an excessive increase in the viscosity of the slurry and therefore necessitate special measures, such as an increase in the mixing and pumping capacity or the addition of viscosity-reducing agents, such as toluene, xylene or cumene sulfonate.

After leaving the mixing unit, which consists of an individual mixer or of a cascade of two or more successive mixers, the homogenized slurry is pumped to a filter, preferably a dynamic filter by means of which soft agglomerates can be crushed. The slurry then passes through another homogenizing unit, for example in the form of a homogenizing pump, and from there flows to a high-pressure pump from which it is pumped to the spray nozzles.

The average residence time of the slurry from the time the various constituents are combined to the moment they enter the high-pressure section should be kept as short as possible and should be no longer than 15 minutes, preferably no longer than 10 minutes and more preferably no longer than 5 minutes.

In another preferred embodiment, the nonionic surfactants are at least partly, preferably completely more preferably to a level of 50 to 90% by weight, fed into a delivery pipe leading to a high-pressure pump and are homogeneously dispersed in the slurry by means of the above-mentioned homogenizing pump. In this way, the residence time of the nonionic surfactants can be shortened to at most 3 minutes and, more especially, to less than 1 minute and any undesirable increase in viscosity counteracted.

The spray-drying process may be carried out in conventional installations of the type already used for the production of conventional, spray-dried detergents. Installations such as these normally consist of round towers which are equipped at their upper end with circularly arranged spray nozzles. They are also equipped with feed systems for the drying gases and also with dust extraction systems for the exhaust. In countercurrent drying, which is generally preferred, the drying gas is introduced into the lower part of the tower and flows in countercurrent to the product stream, whereas in parallel-current drying the drying gases are introduced at the head of the drying tower.

The pressure at the nozzle entrance is 20 to 45 bar and preferably 30 to 40 bar in conjunction with a nozzle bore diameter of 2.5 to 5 mm and preferably 3.0 to 4.0 mm. The ratio of pressure to nozzle bore diameter is therefore 4–18 (bar/mm) and preferably 7.5–13.33 bar/mm. These parameters are unexpectedly crucial to the grain properties of the process products. If they are exceeded in either direction, more or less irregular agglomerates of undesirable structure are formed, particularly if the pressure is increased or the nozzle orifice diameter reduced, resulting in a lower powder density and poorer flow properties. An excessive reduction in pressure can result in defective atomization and in the formation of crusts around the nozzle orifice and in the tower. Inferior powder properties are also obtained where the nozzles used have overly large orifices, i.e. orifices with a diameter considerably larger than 5 mm. It has proved to be particularly favorable to spray under a pressure of around 35 bar for a nozzle orifice diameter of around 3 mm. It is preferred to use nozzles which impart spin to the material to be sprayed.

The spray-drying tower is operated with hot air or with hot combustion gases which preferably flow in countercurrent to the material to be spray-dried. The drying gas is best introduced tangentially into the tower, so that a certain spin effect is obtained. The entry temperature of the drying gas should not exceed 250° C. and is preferably 180° C. to 240° C., more preferably 200° C. to 240° C.

If the spray-drying installation is operated with hotter drying gases, it is necessary to use predominantly highly ethoxylated or mixed-alkoxylated surfactants to suppress pluming in the exhaust. Where the surfactant mixtures (described above as preferred) of compounds having low and high degrees of ethoxylation are used, no problems attributable to pluming will be encountered providing the temperature is kept in the range from 200° to 240° C. The above temperatures refer to the temperature of the gas in the tunnel of the spraying tower. The temperature of the drying gas coming into contact with the powder in the lower part of the tunnel is normally 10° to 30° C. lower.

The temperature of the drying gases on leaving the drying tower is generally from 80° to 95° C. The upper value may vary slightly depending inter alia on the outside temperatures. It should be selected in such a way that the temperature in the subsequent dust extraction units does not fall below the dew point.

The product leaving the spray-drying tower generally has a temperature of 65° C. to 80° C. It has proved to be of advantage to cool the product to a temperature below 35° C., preferably 20° C. to 30° C. starting immediately it leaves the spray-drying tower, so that it is sufficiently cooled within less than 5 minutes and preferably within 2 minutes. This may be done, for example, in a pneumatic conveying system operated with sufficiently cold air, i.e. with air having a temperature below 30° C. Rapid cooling largely prevents the nonionic surfactant from diffusing onto the surface of the sprayed granules. Any nonionic surfactant diffusing onto the surface of the particles can reduce their fluidity and powder density.

If, in hot weather, the temperature of the cooling air is not low enough to cool the product sufficiently quickly, subsequent coating (i.e. dusting or powdering) with a fluidizing agent (also known as an anticaking agent) is recommended. Finely divided water-soluble or water-dispersible solids or other fluidizing agents are suitable and are used in a quantity of 0.01 to 3% by weight, based on the weight of the spray-dried product. In this way, it is possible further to improve fluidity and to avoid adverse effects on the properties of the powder attributable to weather. Finely divided synthetic zeolites of the NaA or NaX type have proved to be particularly suitable fluidizing agents. The positive effect of these zeolites is not only reflected in improved fluidity, it also increases the builder content and hence the detergency of the product. Another suitable fluidizing agent is finely divided silica having a large specific surface, more especially pyrogenic silica of which an example is "AEROSIL" colloidal silica, a trademark of Degussa Corp., Teterboro, N.J., U.S.A. The fluidizing agent is preferably used in a quantity of 0.1 to 2% by weight in the case of the zeolite and preferably in a quantity of 0.05 to 0.5% by weight in the case of the finely divided silica, based on the granular spray-dried product.

Other known anticaking powders for coating tacky detergent granules, such as finely divided sodium tripolyphosphate, sodium sulfate, magnesium silicate, talcum, bentonite and organic polymers, such as carboxymethyl cellulose and urea resins, may also be used providing they have a grain size of less than 0.1 mm, especially of from 0.001 to 0.08 mm. Coarser powders of the type normally used in detergents and cleaning compositions must be correspondingly size-reduced beforehand. Coating agents of this type are preferably used in quantities of from 1 to 3% by weight.

The powder coating of the spray-dried granules may be carried out before, after, or preferably at the same time as the incorporation of other powder components. These other powder components include per compounds, bleach activators (peracid precursors), enzyme granulates, foam inhibitors or foam activators and powder products consisting of carriers and surfactants, more especially anionic surfactants, or of carriers and fabric softeners. The simultaneous introduction of the finely divided coating and other powder components can avoid an additional mixing step.

Water-insoluble coating agents, such as zeolite and silica aerogels, may even be applied to the already formed detergents granules before completion of spray drying, i.e. by blowing them into the lower part of the drying tower along with the drying gas.

Among other things, powder coating of the spray-dried granules results in a certain smoothening of their surface, so that the flow properties of granules which already have a very high bulk density and good flow properties is even further improved because the coating material enables the granules to be more closely packed.

Desirably, the grain spectrum of the spray-dried products according to this invention as determined by sieve analysis is comparatively narrow. Thus, more than 80% by weight and, in most cases, even more than 85% by weight of the granules pass through a 0.2 to 0.8 mm mesh sieve. In conventional spray-dried powders of low bulk density, generally no more than 50 to 70% by weight of the granules are situated in that range. Both the amount of dust in the detergent composition according to the invention and the percentage of oversized grains are also correspondingly low, so that there is no need for the powder coming from the tower to be subsequently sieved or for dust-binding agents to be subsequently added. This results in a more efficacious and less expensive product.

The detergent composition according to the invention is unusually free-flowing and is superior in its flow properties to the known, spray-dried hollow-bead powders of low specific gravity. Its fluidity may be compared with that of dry sand in the standard manner described in the prior art and, as described in the following examples, is more than 60% and preferably between 75% and 95% of that of a dry sand having a standardized grain size distribution.

It is surprising that, despite the high content of nonionic, tacky surfactants and the absence of fine pores capable of taking up those surfactants, the particles of this invention show no tendency to stick together or to release these tacky constituents. In contrast to prior art powders containing an equally high percentage of nonionic surfactant, in which the nonionic surfactant is applied to preformed absorbent spray-dried granulates, the nonionic surfactant of this invention cannot be removed, even partly, by squeezing between filter papers. Accordingly, the particles according to the invention do not cause any greasiness or "saturation" of standard, uncoated paper cartons.

Another important factor in the assessment of a washing powder is its compressibility. In the automatic packaging of a washing powder, the powder inevitably requires a somewhat larger initial packing volume. This volume decreases only slightly during processing, even after brief shaking. During the transportation of the packs to the consumer, the powder then gradually undergoes compression. The consumer notices this reduction in volume on opening the carton and often comes to the conclusion that an incompletely filled carton has been sold. In the case of standard hollow-bead powders of low specific gravity, this reduction in volume amounts to between 10 and 15%. Predominantly spherical granulates obtained by applying nonionic surfactant to presprayed carrier granules show reductions in volume of around 10%. In the case of dry sand as a comparative standard, the reduction in volume is around 8%. The detergents according to the invention surpass even these values, generally showing reductions in volume of less than 10% and, in favorable cases, a reduction of 5%. This high volume stability in conjunction with the outstanding flow properties of the powders provides in particular for accurate and reproducible metering during packaging and in use.

Where unspecified, it is possible to use any of the apparatus and process aids that are now state-of-the-art in the modern spray drying technology.

The process product may be mixed with additional powder products which have been produced by standard methods and which show a different powder spectrum, such as granular bleaches and bleach activators, enzymes and foam regulators which are normally present in granulate form. However, these powder products also include detergent compounds which consist of anionic sulfonate and/or sulfate surfactants and, optionally, soaps together with carriers, such as sodium triphosphate, zeolite A and waterglass, and which are produced by spray drying or mixed granulation. Fabric softening granulates which contain quaternary ammonium compounds as active ingredients together with soluble or insoluble carriers and dispersion inhibitors or granulates which are produced from layer silicates and long-chain tertiary amines may also be added. These additional powder products have other known particle forms, for example more or less spherical beads, prills or granulates.

They should be of such a quality and used in such a quantity that they do not reduce the outer density or free-flow properties of the inventive detergent compositions to any significant extent, if at all.

Other powder components which may be incorporated in the detergent compositions after spray-drying include substances of the type which are unstable or which would lose their specific effect either completely or in part or which adversely affect the properties of the spray-dried product under the spray-drying conditions. Examples of powder components such as these are enzymes such as proteases, lipases and amylases and their mixtures. Enzymatically active ingredients obtained from bacterial strains or fungi, such as *Bacilllus subtillis, Bacillus licheniformis* and *Streptomyces griseus,* are particularly suitable. Fragrances, and defoaming agents such as silicones or paraffin hydrocarbons, when used, are also subsequently added to the spray-dried powder component to avoid loss of activity.

Suitable bleach components for incorporation in the detergents are the perhydrates and other per compounds normally used in detergents and bleaches. Preferred hydrates are sodium perborate, which may be used in the form of the tetrahydrate or monohydrate, and the perhydrates of sodium carbonate (sodium percarbonate), sodium pyrophosphate (perpyrophosphate), sodium silicate (persilicate) and urea.

These perhydrates may be used together with bleach activators.

The preferred bleaching component is sodium perborate tetrahydrate used in conjunction with bleach activators, particularly N-acyl compounds. Examples of suitable N-acyl bleach activator compounds are polyacylated alkylene diamines, such as tetraacetylmethylene diamine, tetraacetylethylene diamine, and acylated glycolurils, such as tetraacetic glycoluril. Other examples are N-alkyl-N-sulfonyl carbonamides, N-acylhydantoins, N-acylated cyclic triazoles, urazoles, diketo-piperazines, sulfuryl amides, cyanurates and imidazolines. In addition to carboxylic acid anhydrides, suitable O-acyl compounds are, in particular, acylated sugars, such as glucose pentaacetate. Preferred bleach activators are tetraacetyl ethylene diamine and glucose pentaacetate.

To avoid any interaction with the other constituents of the powder-form detergents in storage, the enzymes, foam regulators and bleach activators may be granulated and/or coated with shell-forming substances soluble in water or dispersible in wash liquors in known manner. Suitable granulating agents are any of the usual salts capable of taking up water of hydration. Suitable shell-forming substances are water-soluble polymers, such as polyethylene glycol, cellulose ethers, cellulose esters, water-soluble starch ethers and starch esters and also nonionic surfactants of the alkoxylated alcohol, alkylphenol, fatty acid and fatty acid amide types.

The detergent composition produced in accordance with the invention generates very little foam and may readily be used in automatic washing machines. In cases where the detergents are required to foam vigorously in use, particularly in the washing of delicate fabrics or for low-temperature washing which is frequently done by hand, foam-active surfactants and surfactant mixtures, preferably in compounded form, are subsequently added to the spray-dried powder. Foam-active surfactants include known anionic surfactants of the sulfonate and sulfate type and zwitterionic surfactants. In addition, an additive such as this can produce a further increase in detergency. The foam-active surfactants may be added in a quantity of up to 10% by weight and preferably in a quantity of 0.2 to 8% by weight, based on the weight of the final mixture. Anionic surfactants suitable for this purpose include alkylbenzene sulfonates, such as n-dodecyl-benzene sulfonate, olefin sulfonates, alkane sulfonates, primary or secondary alkylsulfates, sulfofatty acid esters and sulfates of ethoxylated and propoxylated, relatively high molecular weight alcohols, monoalkylated and dialkylated sulfosuccinates, sulfuric acid esters of fatty acid partial glycerides and fatty acid esters of 1,2-dihydroxypropane sulfonic acid. Suitable zwitterionic surfactants are alkylbetaines and, in particular, alkylsulfobetaines, such as 3-(N,N-dimethyl-N-alkylammonium)-propane-1-sulfonate and 2-hydroxypropane-1-sulfonate.

Of the surfactants mentioned, the alkylbenzene sulfonates, olefin sulfonates, alkane sulfonates, fatty alcohols sulfates and α-sulfofatty acid esters are preferred by virtue of their foam-activating and, at the same time, detergency-boosting effect. If particular importance is attributed to foam activation, it is advisable to use sulfates of ethoxylated fatty alcohols, more especially containing from 1 to 3 glycol ether moieties, and/or alkylsulfobetaines.

The anionic surfactants and their mixtures are preferably used in the form of the sodium or potassium salts and as salts of organic bases, such as mono-, di- or triethanolamine.

Where the anionic and zwitterionic compounds mentioned contain an aliphatic hydrocarbon radical, this radical should preferably be linear and should contain 8 to 20 carbon atoms and more especially 12 to 18 carbon atoms. In the compounds containing an araliphatic hydrocarbon radical, the preferably unbranched alkyl chains contain on average 6 to 16 carbon atoms and more especially 8 to 14 carbon atoms.

The anionic and zwitterionic surfactants which may optionally be additionally used are also beat used in granulated form. Suitable granulating agents and carriers are the usual inorganic salts, such as sodium sulfate, sodium carbonate, phosphates and zeolites and also their mixtures.

Fabric-softening additives generally consist of granulates which contain a softening quaternary ammonium compound (QUAT), for example distearyldimethylammonium chloride, a carrier and an additive which delays dispersion in the wash liquor. A typical granulate such as this comprises 86% by weight of QUAT, 10% by weight of pyrogenic silica and 4% by weight of silicone oil and activated (with pyrogenic silica) polydimethylsiloxane. Another typical granulate comprises 30% by weight of QUAT, 20% by weight of sodium phosphate, 20% by weight of zeolite NaA, 15% by weight of waterglass, 2% by weight of silicone oil and water q.s. to 100%.

When selecting the grain specification and in the granulation and coating of the additives, it is important to ensure that the bulk density and average grain size of the particles do not differ significantly from the corresponding parameters of the spray-dried products according to the invention and that the particles do not have an excessively rough or irregular surface. However, since the additional powder constituents generally make up no more than 10 to 40% by weight and preferably no more than 30% by weight of the final mixture, the effect of the additives on the properties of the powder is generally minimal.

EXAMPLE 1

The apparatus used for preparing the slurry consisted of a cascade of three successive mixing vessels each having a capacity of 1.5 $m^3$. Vessels 1 and 2 were equipped with turbine impellers (rotational speed 480 r.p.m.). The third vessel served as equalizing vessel for continuous operation. The stirrer installed therein rotated at 280 r.p.m. To prevent separation of the slurry, a maximum level of 0.5 $m^3$ was adjusted in the third vessel. The average residence time in the three-stage mixing unit was 5 minutes.

In the first mixing vessel, batches of slurry were premixed at 30-second intervals, each batch weighing 123.2 kg. The liquid constituents heated to 70° C. were introduced first. They consisted of molten nonionic surfactants, the aqueous pumpable aluminosilicate filter cake and a series of aqueous active-substance solutions. The solids were added at brief intervals in a sequence corresponding to the order in which the solids are listed in Table 1. The liquid slurry was heated to 95° C. by the introduction of steam and then transferred via an overflow pipe to the second mixing vessel in which it was homogenized with introduction of more steam. The various quantities used are shown below.

TABLE 1

| Constituent | Slurry (kg) | Water content (kg) |
|---|---|---|
| Tallow fatty alcohol + 14 EO | 7.7 | — |
| Tallow fatty alcohol + 5 EO | 6.7 | — |
| Oleyl-/cetyl alcohol + 8 EO | 7.9 | — |
| Optical brightener | 1.9 | 1.7 |
| Cellulose ether | 1.0 | 0.3 |
| Na—EDTMP | 2.1 | 1.4 |
| Aluminosilicate (suspension) | 27.9 | 15.1 |
| Na—silicate ($Na_2$:$SiO_2$ = 1:3.3) | 23.1 | 15.0 |
| Sodium hydroxide | 6.1 | 4.3 |

TABLE 1-continued

| Constituent | Slurry (kg) | Water content (kg) |
|---|---|---|
| Tripolyphosphate | 38.8 | 3.9 |
| Total | 123.2 | 41.7 |
| Additional water (including condensed steam) | — | 15.0 |

EO = ethylene oxide groups;
Cellulose ether = mixture of 2 parts of sodium carboxymethyl and 1 part of methyl cellulose;
EDTMP = ethylene diaminotetramethylene phosphonate The ratio of sodium silicate and sodium hydroxide corresponded to a ratio of $Na_2O$ to $SiO_2$ of 1:2. The tripolyphosphate was prehydrated (1% water). After complete homogenization, each slurry contained 96.5 kg of anhydrous solids and 56.7 kg of water (water content 41.0% by weight).

The slurry delivered to and continuously removed from the third mixing vessel had a viscosity of 11,500 mPa.s. at 95° C. It was passed through a dynamic sieve (a product of Ballestra S.p.A., Milan, Italy) in order to destroy any soft agglomerates present. The slurry was then pumped to a continuous homogenizer and, after passing through a high-pressure pump, was delivered via a riser to the atomizing nozzles of a spray-drying tower. The one-component nozzles in the form of spin nozzles had a bore diameter of 3 mm. The ratio of pressure to bore diameter was 11.3 bar/mm. The throughput amounted to 12 t/h, based on spray-dried powder.

The drying gas (throughput 60,000 $m^3$/h) which was introduced into the spray drying tower with spin from below and which had been heated by burning natural gas had an entry temperature, as measured in the tunnel, of 220° C. and an exit temperature, as measured in the filter, of 90° C. The dust explosion limit was not reached at a powder concentration of from 30 to 200 g/$m^3$, i.e. the product has a dust explosion rating of 0. The smoke meter on the exit side of the exhaust filter showed a deflection of from 0.02 to 0.08 unit on the scale.

After leaving the spray-drying tower, the spray-dried product was slightly tacky and had a temperature of 70° C. It was cooled to a temperature of 26° C. in less than 1 minute in a pneumatic conveying system. It consisted of slightly tacky, free-flowing, substantially spherical particles having a smooth surface and a homogenous cross-section. The content of coarse particles (1.6 mm–3 mm) and of dust was less than 0.1% by weight. The granules had a bulk powder density of 750 g/l and contained 13.1% by weight of water removable at 130° C. (drying temperature). Sieve analysis produced the following grain size distribution (% by weight):

>1.6 mm=0%, 1.6–0.8 mm=3%, 0.8–0.4 mm=48%, 0.4–0.2 mm=48%, 0.2–0.1 mm=1%, >0.1 mm=0%.

To determine flow behavior, 1 liter of the powder was introduced into a funnel closed at its outlet opening and having the following dimensions:

| | |
|---|---|
| diameter of the upper opening | 150 mm |
| diameter of the lower opening | 10 mm |
| height of the conical funnel section | 230 mm |
| height of the lower cylindrical section | 20 mm |
| angle of inclination of the conical section (towards the horizontal) | 73° |

Dry sea sand having the following grain distribution was used as the comparison substance:

| size (mm) | >1.5 | 0.8–1.5 | 0.4–0.8 | 0.2–0.4 | 0.1–0.2 | 0–0.1 |
|---|---|---|---|---|---|---|
| weight distribution (%) | 0 | 0.2 | 11.9 | 54.7 | 30.1 | 3.0 |

The outflow time of the dry sand after the outlet opening had been released was put at 100%. The following comparison values were obtained (average values from 5 tests):

| Test material | Fluidity |
|---|---|
| (a) sand (standard) | 100% |
| (b) test product (Example 1) | 85% |
| (c) commercial hollow-bead powder (Comparison) | 60–70% |
| (d) carrier bead produced by spray drying and after treated with 20% of nonionic surfactant (Comparison) | 86% |

For finishing, 87.0 parts by weight of the test product were mixed with:

10 parts by weight of powder-form sodium perborate tetrahydrate which had been sprayed with 0.2 parts by weight of perfume oil:

0.5 part by weight of an enzyme granulate produced by prilling an enzyme melt; and 2.3 parts by weight of granulated tetraacetylethylene diamine, the grain size of the added constituents amounting to between 0.1 and 1 mm. The powder density was thus increased to 760 g/l. There was no change in fluidity within the tolerance limits.

The mixture proved to be a high-quality detergent suitable for use at temperatures in the range 30° C. to 100° C. The test product was no different from a loose spray-dried powder in its ability to be flushed in from the powder compartments of fully automatic washing machines, or did it leave any residues. By contrast, the dissolving properties of the comparison product (d) were poorer, resulting in the formation of residues both in the powder compartment and on the fabrics themselves.

EXAMPLE 2

The apparatus described in Example 1 comprising 3 successive mixing vessels arranged in a cascade were again used for the continuous preparation of the slurry. Through an additional feed pipe equipped with a continuous metering unit, other liquid constituents, more especially liquid or molten nonionic surfactants, could be fed into the pipe system—leading to the high pressure pump—between the dynamic sieve and the homogenizer.

The alkoxylated nonionic surfactant component (a) used was a mixture of nonylphenol+6 EO and nonylphenol+ 10 EO in a ratio by weight of 1:2. Of this mixture, 33% was introduced into the last mixing vessel and 67% into the pipe system leading to the high pressure pump. The formulation was the same as in Table 1 except that the proportion of nonionic surfactant amounted to 12.3 kg and the balance to 123.2 kg consisted of an aqueous sodium sulfate solution (water content 50% by weight). The average residence time of the slurry as a whole was less than 5 minutes and that of the nonionic surfactant less than 1 minute. The viscosity of the slurry leaving the third mixing vessel was 10,800 mPa.s.

Spray drying was carried out under the conditions described in Example 1 until the amount of water removed at 130° C. equalled 13.5% by weight. The spray-dried product had a bulk powder density of 630 g/l. After powdering with 2.5% by weight of finely divided, crystalline zeolite NaA, the bulk powder density was increased to 680 g/l. 96.5% by weight of the product had a particle size of from 0.2 to 0.8 mm. The content of coarse grains (over 1.6 mm) and dust (under 0.1 mm) was less than 0.5% by weight. Fluidity based on the dry sand standard amounted to 87%.

I claim:

1. A process for the production of a granular detergent composition comprising:

(A) mixing into an aqueous slurry (a) 10–28% of at least one alkoxylated nonionic surfactant, (b) 40–80% of at least one inorganic carrier, (c) 0.5–10% of at least one organic washing auxiliary and (d) 35–50% of a total quantity of water including 10–20% of water bound by adsorption and water of hydration, with the proviso that anionic surfactants are not present in an amount greater than 0.5%, all percentages being by weight and based upon the weight of the entire composition;

(B) continuously and intensively homogenizing said slurry to adjust and maintain its viscosity at 4,000–20,000 mPa.s at a temperature of between 85° C. and 105° C.;

(C) heating said slurry to maintain its temperature at 85°–105° C.;

(D) feeding said heated, homogenized slurry to a high pressure pump from which said slurry is pumped to spray nozzles;

(E) spraying said heated, homogenized slurry through said nozzles into a dynamic drying-gas flowing drying tower at a pressure of 20 to 45 bar, said nozzles having a bore diameter of 2.5 to 5 mm and the ratio of said pressure to said bore diameter being 4–18 bar/mm; and (F) removing the detergent composition thus formed, which formed composition is rapidly soluble in water, free-flowing, has a bulk density of at least 600 g/l, and a particle size of 0.1–2 mm.

2. The process of claim 1 wherein (a) said at least one alkoxylated nonionic surfactant comprises:

ethoxylated $C_{12-24}$-alcohol containing on average 3–20 glycol ether moieties, and which may be saturated or monosaturated, linear or methyl-branched in the 2-position, and is derived from naturally occuring fatty residues; alkoxylated $C_{12-24}$-alcohol in which 1–3 mols of propylene oxide are first added to the alcohol and then 4–20 mols of ethylene oxide are added; ethoxylated $C_{8-12}$-alkylphenol containing 4–14 mols of ethylene oxide; ethoxylated or propoxylated vicinal diol, fatty amine, fatty acid amide, or fatty acid; or amine oxide or amine oxide containing polyglycol ether moieties;

(b) said at least one inorganic carrier comprises: polymer phosphate alkali metal or ammonium salt; alkali metal silicate; aluminosilicate which is zeolite A, zeolite X, or their mixture; or sodium carbonate, sodium sulfate, magnesium silicate, finely divided silica, clay, bentonite, or their mixtures; and (c) said at least one organic washing auxiliary comprises:

a co-builder capable of enhancing the effect of any builder present as an inorganic carrier; a redeposition inhibitor; an optical brightener; or a viscosity regulator.

3. The process of claim 1 wherein ingredient (a) is present in 12–25%, ingredient (b) is present in 45–70%, ingredient (c) is present in 0.5–10%, ingredient (d) is present in 38–45% including 12–18% of water bound by adsorption and water of hydration, and substantially no anionic surfactants are present.

4. The process of claim 2 wherein ingredient (a) is present in 12–25%, ingredient (b) is present in 45–70%, ingredient (c) is present in 0.5–10%, ingredient (d) is present in 38–45% including 12–18% of water bound by adsorption and water of hydration, and substantially no anionic surfactants are present.

5. The process of claim 3 wherein ingredient (a) is present in 15–23%, and ingredient (c) is present in 1–5%.

6. The process of claim 4 wherein ingredient (a) is present in 15–23%, and ingredient (c) is present in 1–5%.

7. The process of claim 6 wherein in ingredient (b):

alkali metal tripolyphosphate is present in 0 to 60%; alkali metal silicate is present in 5–20%; and alkali metal aluminosilicate is present in 0–40%; the total quantity of ingredient (b) being at least 45%.

8. The process of claim 7 wherein in ingredient (b):

sodium tripolyphosphate is present in 10–50%; akali metal silicate is present in 6–15%; and sodium aluminosilicate is present in 3–30%.

9. The process of claim 8 wherein in ingredient (b);

said sodium tripolyphosphate is present in 20–40%; said alkali metal silicate is present in 6.5–12%; and said sodium aluminosilicate is present in 5–25%.

10. The process of claim 8 wherein said alkali metal silicate has the composition $Na_2O:SiO_2$ in a ratio of 1:1.5–3.5, 11. The process of claim 9 wherein said alkali metal silicate has the composition $Na_2O:SiO_2$ in a ratio of 1:2–2.5.

12. The process of claim 1 wherein the viscosity of said aqueous slurry is adjusted to and maintained at 5,000 to 20,000 mPa.s at a temperature of between 85° C. and 105° C.

13. The process of claim 1 wherein the viscosity of said aqueous slurry is adjusted to and maintained at 5,000 to 15,000 mPa.s at a temperature of between 90° C. and 102° C.

14. The process of claim 1 wherein said aqueous slurry is heated to and maintained at a temperature of 90° to 102° C.

15. The process of claim 13 wherein said aqueous slurry is heated to and maintained at a temperature of 90° to 102° C.

16. The process of claim 1 wherein the continuous homogenization is carried out in a cascade of at least two successive mixers in which the average total residence time of said slurry is no longer than 10 minutes.

17. The process of claim 1 wherein the continuous homogenization is carried out in a cascade of at least two successive mixers in which the average total residence time of said slurry is no longer than 5 minutes.

18. The process of claim 15 wherein the continuous homogenization is carried out in a cascade of at least two successive mixers in which the average total residence time of said slurry is no longer than 5 minutes.

19. The process of claim 18 wherein a fraction comprising 50–90% by weight of said at least one alkoxylated nonionic surfactant is introduced after the remaining slurry ingredients have been homogenized in said cascade by feeding said fraction and said slurry through a further homogenizing unit prior to feeding the homogenized combined slurry to said high pressure pump, so that the slurry resident time of said alkoxylated nonionic surfactant fraction is not more than 3 minutes.

20. The process of claim 19 wherein the slurry residence time of said alkoxylated surfactant fraction is less than 1 minute.

21. The process of claim 1 wherein said slurry is sprayed at a pressure of 30–40 bar, said nozzles have a bore diameter of 3.0 to 4.0 mm, and the ratio of said pressure to said bore diameter is 7.5–13.33 bar/mm.

22. The process of claim 18 wherein said slurry is sprayed at a pressure of 30–40 bar, said nozzles have a bore diameter of 3.0 to 4.0 mm, and the ratio of said pressure to said bore diameter is 7.5–13.33 bar/mm.

23. The process of claim 1 wherein said drying-gas enters said drying tower at a temperature of 180°–240° C. and flows countercurrent to the material being sprayed.

24. The process of claim 22 wherein said drying-gas enters said drying tower at a temperature of 200°–240° C. and flows countercurrent to the material being sprayed.

25. The process of claim 1 wherein said drying gas is introduced into said drying tower tangentially, so that it imparts spin to the material being dried.

26. The process of claim 24 wherein said drying gas is introduced into said drying tower tangentially, so that it imparts spin to the material being dried.

27. The process of claim 1 wherein the spray-dried detergent composition is cooled to a temperature below 35° C. starting immediately it is removed from said drying tower, so that it is sufficiently cooled within less than 5 minutes.

28. The process of claim 26 wherein the spray-dried detergent composition is cooled to a temperature below 35° C. starting immediately it is removed from said drying tower, so that it is sufficiently cooled within 2 minutes.

29. The process of claim 1 wherein in a further step, said formed detergent composition is dusted with a fluidizing agent used in an amount of 0.01–3% by weight based on the weight of said formed detergent composition.

30. The process of claim 28 wherein in a further step, said formed detergent composition is dusted with a fluidizing agent used in an amount of 0.01–3% by weight based on the weight of said formed detergent composition.

31. The product of the process of claim 1.

32. The product of the process of claim 2.

33. The product of the process of claim 10.

34. The product of the process of claim 28.

35. The product of the process of claim 30.

* * * * *